US009459587B2

(12) United States Patent
Kokubu et al.

(10) Patent No.: US 9,459,587 B2
(45) Date of Patent: Oct. 4, 2016

(54) IMAGE FORMING APPARATUS

(71) Applicant: FUJI XEROX CO., LTD., Tokyo (JP)

(72) Inventors: Fuyuki Kokubu, Kanagawa (JP); Akira Numazaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/686,264

(22) Filed: Apr. 14, 2015

(65) Prior Publication Data

US 2016/0070230 A1 Mar. 10, 2016

(30) Foreign Application Priority Data

Sep. 5, 2014 (JP) ..... 2014-181144

(51) Int. Cl.
*G03G 15/00* (2006.01)
*G03G 21/20* (2006.01)
*G03G 15/04* (2006.01)

(52) U.S. Cl.
CPC ..... *G03G 21/206* (2013.01); *G03G 15/04* (2013.01)

(58) Field of Classification Search
CPC ..... G03G 21/206; G03G 15/04
See application file for complete search history.

(56) References Cited

U.S. PATENT DOCUMENTS 8,818,230 B2 * 8/2014 Murano ..... G03G 21/206 399/61
2013/0016992 A1 * 1/2013 Watanabe ..... G03G 15/04036 399/92

FOREIGN PATENT DOCUMENTS

JP 2006-072030 A 3/2006
JP 2007-140349 A 6/2007
JP 2008-286969 A 11/2008

* cited by examiner

*Primary Examiner* — David Gray
*Assistant Examiner* — Michael Harrison
(74) *Attorney, Agent, or Firm* — Sughrue Mion, PLLC

(57) ABSTRACT

An image forming apparatus includes an exposure unit that forms a latent image by irradiating a photoconductor body with light by using light emitting elements that are arranged along an axial direction of the photoconductor body, the exposure unit having an inlet to which air flow is introduced; and an air blowing unit that produces the air flow that is introduced to the exposure unit from an air blow opening that is provided at a position that is in correspondence with a position of the inlet of the exposure unit.

14 Claims, 11 Drawing Sheets

IMAGE FORMING APPARATUS

CROSS-REFERENCE TO RELATED APPLICATIONS

This application is based on and claims priority under 35 USC 119 from Japanese Patent Application No. 2014-181144 filed Sep. 5, 2014.

BACKGROUND

Technical Field

The present invention relates to an image forming apparatus.

SUMMARY

According to an aspect of the invention, there is provided an image forming apparatus including an exposure unit that forms a latent image by irradiating a photoconductor body with light by using light emitting elements that are arranged along an axial direction of the photoconductor body, the exposure unit having an inlet to which air flow is introduced; and an air blowing unit that produces the air flow that is introduced to the exposure unit from an air blow opening that is provided at a position that is in correspondence with a position of the inlet of the exposure unit.

BRIEF DESCRIPTION OF THE DRAWINGS

An exemplary embodiment of the present invention will be described in detail based on the following figures, wherein.

DETAILED DESCRIPTION

An exemplary embodiment of the present invention (hereunder simply referred to as "exemplary embodiment") is hereunder described with reference to the attached drawings.

Figure 1:
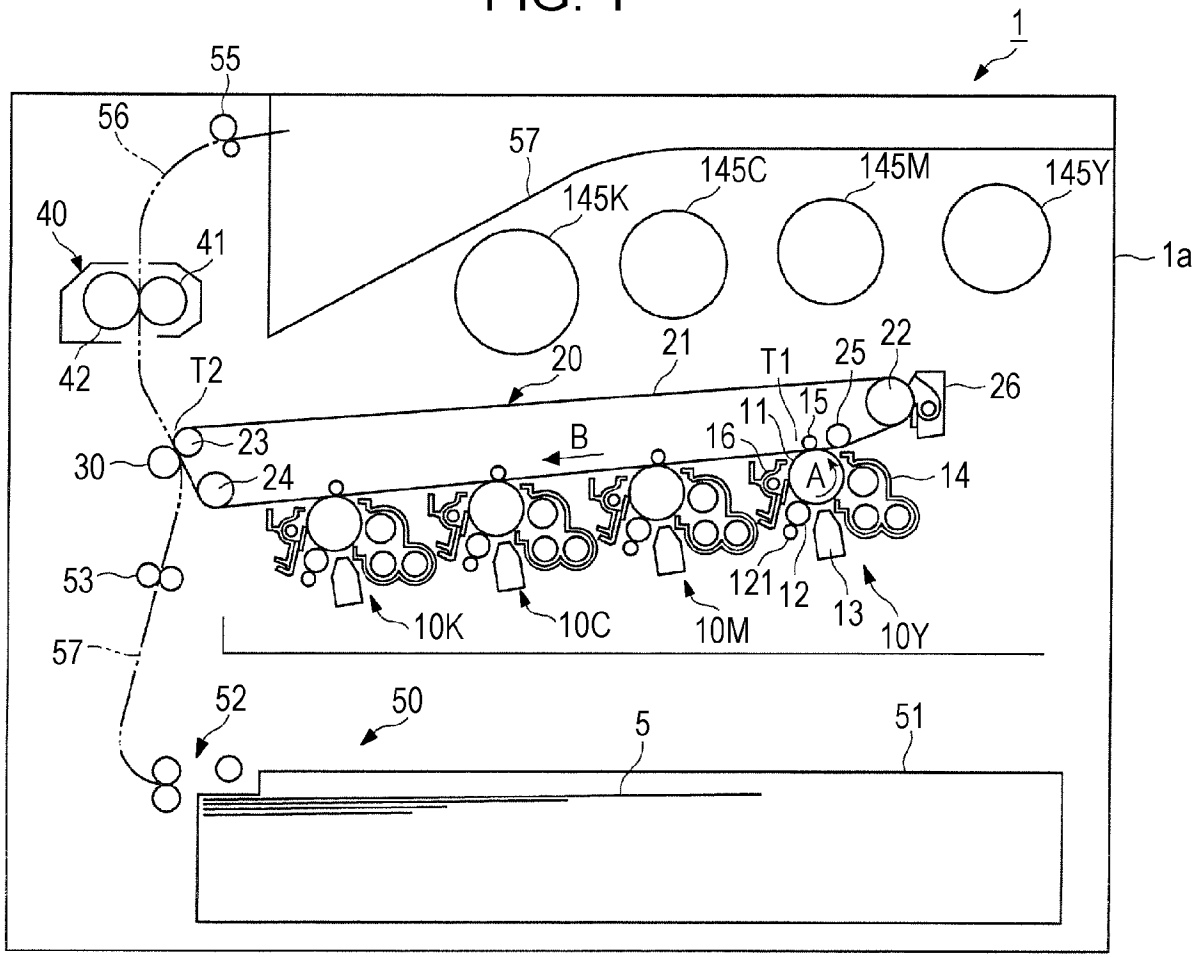
FIG. 1 illustrates an image forming apparatus according an exemplary embodiment of the present invention.
Figure 2:
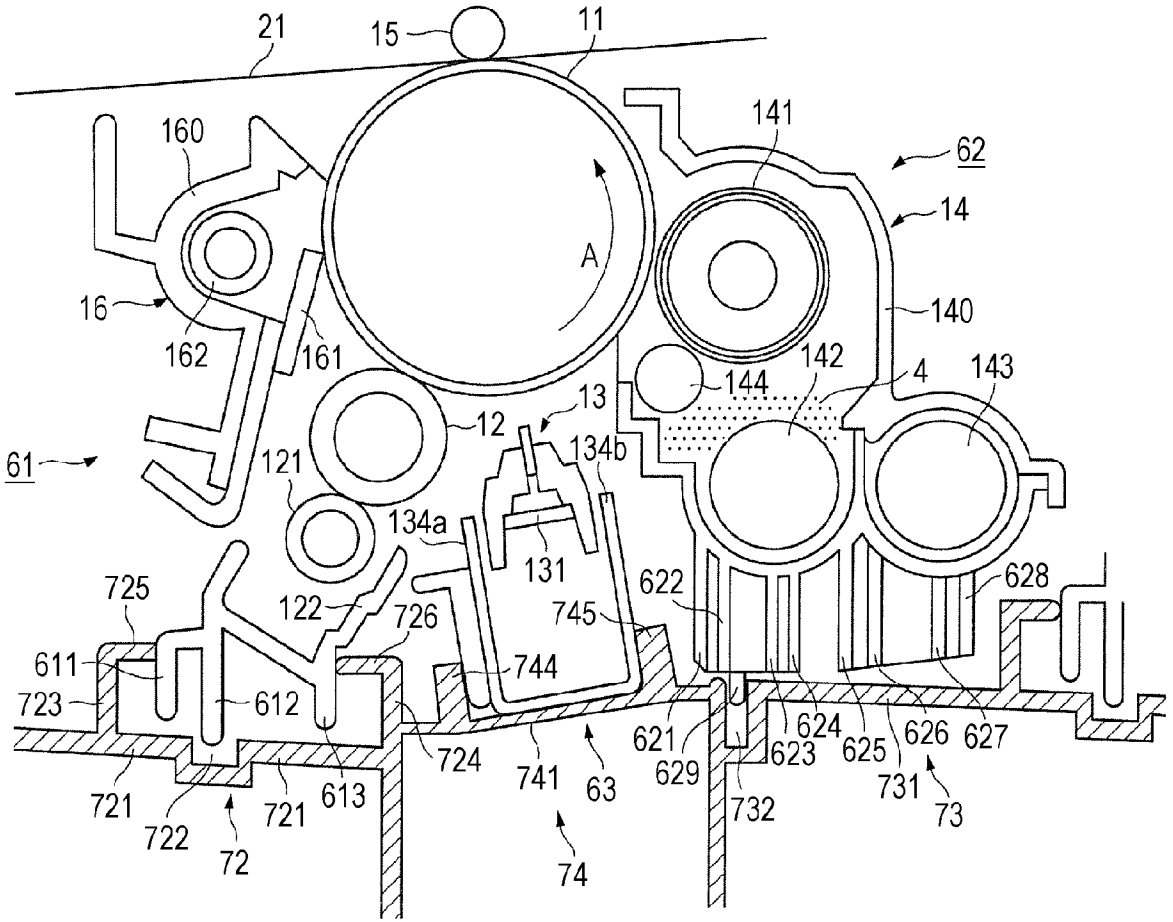
FIG. 2 illustrates a structure of an image forming unit of the image forming apparatus according to the exemplary embodiment of the present invention.

FIGS. 1 and 2 each illustrate an image forming apparatus 1 according to the exemplary embodiment. FIG. 1 is a general view of the entire image forming apparatus 1. FIG. 2 is an enlarged view of a principal portion (such as an image producing unit) of the image forming apparatus 1.

Structure of Entire Image Forming Apparatus

The image forming apparatus 1 according to the exemplary embodiment is, for example, a color printer. The image forming apparatus 1 includes, for example, multiple image producing devices 10, an intermediate transfer device 20, a sheet feeding device 50, and a fixing device 40. Each image producing device 10 forms a toner image formed by development using toner of developer 4. The intermediate transfer device 20 holds the toner images, formed by the respective image producing devices 10, and transports the toner images to a second transfer position T2, where the toner images are finally second-transferred to recording paper 5, which is an exemplary recording medium. The sheet feeding device 50 contains and transports pieces of recording paper 5 that need to be supplied to the second transfer position T2 of the intermediate transfer device 20. The fixing device 40 fixes the toner images on the pieces to recording paper 5 to which the toner images have been second-transferred by the intermediate transfer device 20.

A body 1*a* of the image forming apparatus 1 includes, for example, a supporting structure member and an external cover. In FIG. 1, an alternate long and two short dash line represents a principal transport path along which the pieces of recording paper 5 are transported in the body 1*a*.

The image producing devices 10 correspond to four image producing devices 10Y, 10M, 10C, and 10K, which are provided specially for forming toner images of four colors, that is, a yellow (Y) toner image, a magenta (M) toner image, a cyan (C) toner image, and a black (K) toner image, respectively. In a state in which the four image producing devices 10Y, 10M, 10C, and 10K are tilted with respect to a horizontal direction in an internal space of the body 1*a*, in the illustrated exemplary embodiment, the image producing devices 10Y, 10M, 10C, and 10K are arranged in one row such that the image producing device 10Y for yellow (Y) is positioned at a highest position along a vertical direction compared to the other image producing devices 10M, 10C, and 10K, and the image producing device 10K for black (K) is positioned at a lowest position along the vertical direction compared to the other image producing devices 10Y, 10M, and 10C.

Referring to FIGS. 1 and 2, each of the image producing devices 10Y, 10M, 10C, and 10K includes a photoconductor drum 11, which is an exemplary image holding member, that rotates. Devices such as those described below are principally disposed around each of the photoconductor drums 11. The principal devices include, for example, a charging device 12, an exposure device 13, a developing device 14Y, 14M, 14C, or 14K, a first transfer device 15, and a drum cleaning device 16. Each charging device 12 charges a peripheral surface (an image holding surface) of the corresponding photoconductor drum 11, where an image is formable, to a required potential. Each exposure device 13, which is an exemplary exposure unit, irradiates the charged peripheral surface of the corresponding photoconductor drum 11 with light (which is based on image information (signal)), and forms an electrostatic latent image (for its corresponding color) having a potential difference. Each of the developing devices 14Y, 14M, 14C, and 14K is an exemplary developing unit that develops the corresponding electrostatic latent image with toner of the developer 4 of the corresponding color (Y, M, C, or K) and forms the corresponding electrostatic latent image into the corresponding toner image. Each first transfer device 15 transfers the corresponding toner image to the intermediate transfer device 20. Each drum cleaning device 16 removes and cleans off extraneous matter, such as toner, that remains on and adheres to the image holding surface of the corresponding photoconductor drum 11 after the first transfer.

Each photoconductor drum 11 is a drum in which the image holding surface having a photoconductive layer (a photosensitive layer), formed of a photosensitive material, is formed at a peripheral surface of a cylindrical or a columnar base member that is connected to ground. Each photoconductor drum 11 is supported so as to rotate in the direction of arrow A as a result of transmission of power from a rotary driving device (not shown).

Each charging device 12 is a contact charging device, such as a charging roller, that is disposed in contact with the corresponding photoconductor drum 11. Each charging device 12 includes a roller-type cleaning member 121 that cleans a peripheral surface of the corresponding charging roller.

Each exposure device 13 irradiates the peripheral surface of the corresponding charged photoconductor drum 11 with the light that is provided in accordance with the image information that is input to the image forming apparatus 1, and forms the corresponding electrostatic latent image. When the electrostatic latent images are to be formed, the image information (signal) that is input to the image forming apparatus 1 by any method is transmitted to the corresponding exposure device 13.

Each exposure device 13 is an LED print head that irradiates the corresponding photoconductor drum 11 with light by using multiple light emitting diodes (which are light emitting elements) that are arranged along an axial direction of the corresponding photoconductor drum 11, and forms the corresponding electrostatic latent image.

Figure 3:
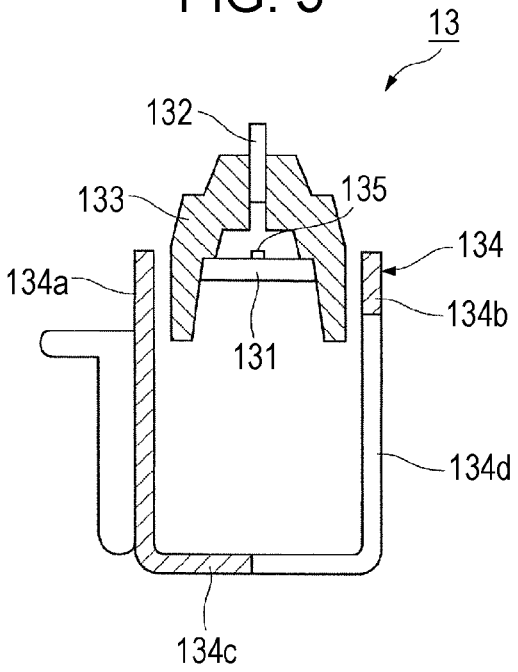
FIG. 3 is a sectional view of a structure of an exposure device.
Figure 4:
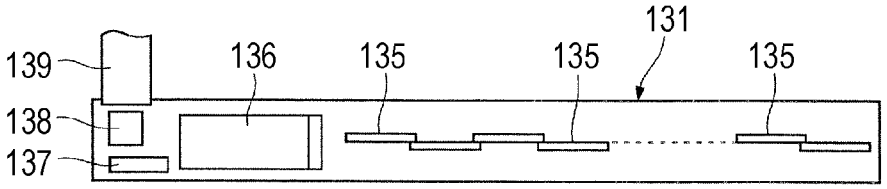
FIG. 4 is a plan view of a structure of a principal portion of the exposure device.

Referring to FIG. 3, each LED print head 13 includes an LED circuit board 131, a lens array 132 that is disposed so as to oppose the corresponding LED circuit board 131, a holder 133, which is a holding member, that holds the LED circuit board 131 and the lens array 132, and a housing 134 that is disposed around the outer periphery of the corresponding holder 133. Referring to FIG. 4, each LED circuit board 131 has a long flat form, with multiple LED arrays 135 (more specifically, twenty LED arrays 135) being disposed on the top surface of the corresponding LED circuit board 131 in a staggered arrangement along a longitudinal direction of the LED circuit board 131. In each LED array 135, multiple light emitting elements (more specifically, 256 light emitting elements), which are LEDs, are linearly arranged along the longitudinal direction.

In each LED circuit board 131, a driving circuit 136 for causing the multiple LED arrays 135 to emit light in accordance with the image information, a storage element 137 that stores the image data, a power supply circuit 138 that energizes the multiple LED arrays 135 are provided at one end portion of the LED arrays 135. Further, a wire harness 139 that receives image data and a control signal from a controller is connected to the corresponding LED circuit board 131.

Figure 5:
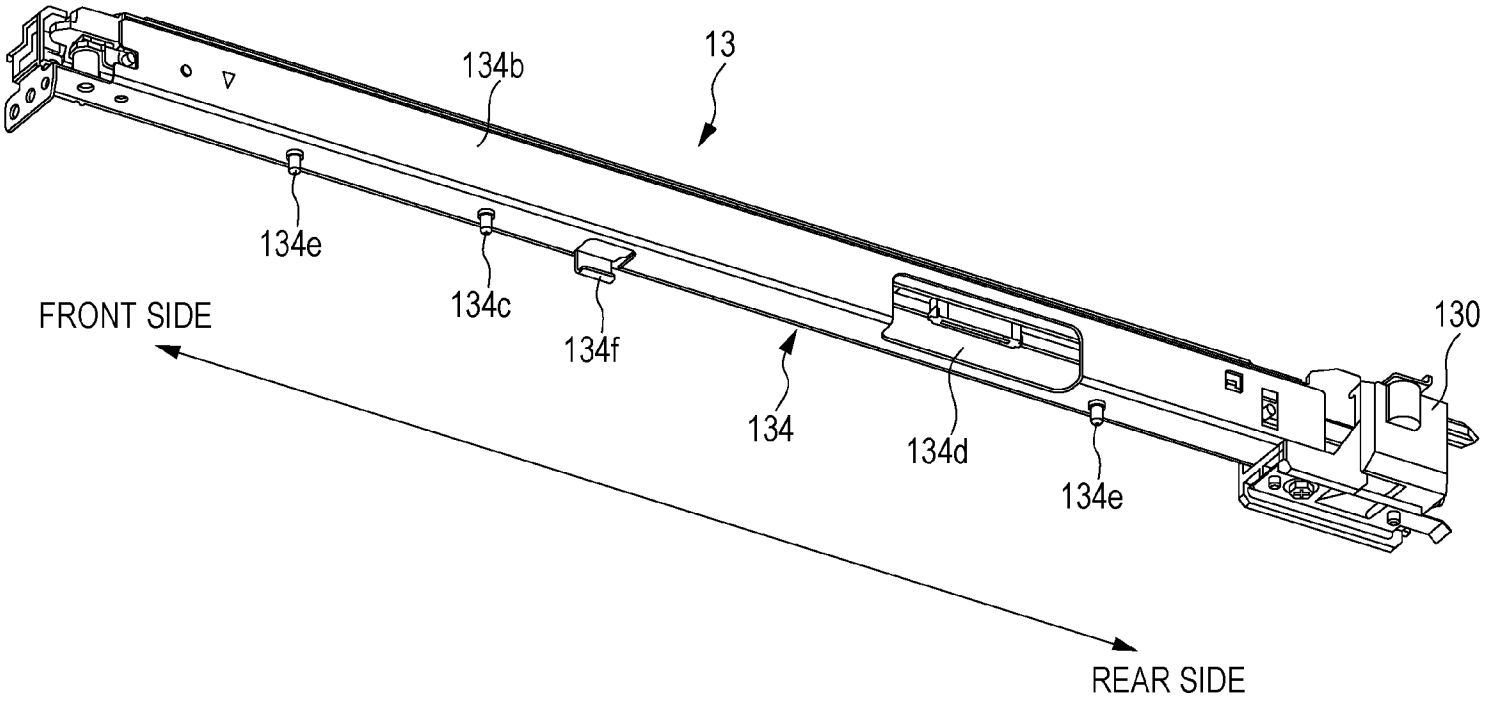
FIG. 5 is a perspective view of the structure of the exposure device.

The housing 134 of each exposure device 13 is formed of a rigid material, such as a metal plate. The housing 134 of each exposure device 13 is a frame member which is rectangular in cross section, which includes a left side wall 134*a*, a right side wall 134*b*, and a bottom wall 134*c*, and which has an open top that is positioned adjacent to the corresponding photoconductor drum 11. Both end portions along a longitudinal direction of each holder 133 that holds the LED circuit board 131 and the lens array 132 are mounted on the corresponding housing 134 while being secured thereto by any method, such as by using screws. Referring to FIG. 5, each housing 134 has a rectangular inlet 134*d* that extends from the side wall 134*b* to the bottom wall 134*c* so as to be positioned closer to a rear side than an intermediate portion along a longitudinal direction thereof, and that introduces air into the corresponding housing 134 from an air blow opening that is provided in the body 1*a* of the image forming apparatus 1. Each inlet 134*d* also serves as an insertion opening for inserting therein the wire harness 139 that is connected to the corresponding LED circuit board 131.

Further, downwardly protruding guide pins 134*e* that guide the corresponding exposure device 13 are provided at the bottom wall 134*c* of the housing 134 of the corresponding exposure device 13. In addition, a positioning member 134*f* for positioning and securing the corresponding exposure device 13 with respect to the body 1*a* of the image forming apparatus 1 is integrally formed with the bottom wall 134*c* of the housing 134 of the corresponding exposure device 13 while a side surface of the positioning member 134*f* is bent in a substantially L shape.

In FIG. 5, reference numeral 130 denotes a socket member for positioning and fixing the corresponding exposure device 13 with respect to a predetermined position of the body 1*a* of the image forming apparatus 1. Each socket member is mounted on the body 1*a* of the image forming apparatus 1.

In this way, by using each LED print head 13 that is not provided with a movable portion as the corresponding exposure device 13, it is possible to cause the size of each exposure device 13 to be smaller than an exposure device that uses a laser system that causes laser light to repeatedly scan the photoconductor body by a rotating polygon mirror in an axial direction. This makes it possible to form each exposure device 13 as a unit that is removable from the body 1*a* of the image forming apparatus 1. Each exposure device 13 may be unitized as a single exposure device, or may be unitized along with, for example, the corresponding developing device 14 and the corresponding charging device 12.

Referring to FIG. 2, in each of the developing devices 14Y, 14M, 14C, and 14K, for example, a developing roller 141, stirring transporting members 142 and 143 (such as screw augers), and a layer thickness restricting member 144 are disposed in a corresponding housing 140 including the opening and a chamber for the developer 4. Each developing roller 141 holds the developer 4 and transports the developer 4 up to a development region that opposes the corresponding photoconductor drum 11. While stirring the developer 4, the stirring transporting members 142 and 143 transport the corresponding developer 4 so that the developer 4 passes the corresponding developing roller 141. Each layer thickness restricting member 144 restricts the amount of developer (layer thickness) on the corresponding developing roller 141. Development voltage is supplied from a power supply device (not shown) to a location between the developing roller 141 of each developing device 14 and the corresponding photoconductor drum 11. Power from a rotary driving device (not shown) is transmitted to each developing roller 141 and each of the stirring transporting members 142 and 143, so that each developing roller 141 and each of the stirring transporting members 142 and 143 rotate in a required direction. Further, as the developers 4Y, 4M, 4C, and 4K of the four colors, two-component developers including nonmagnetic toner and magnetic carriers are used. In FIG. 1, reference numerals 145Y, 145M, 145C, and 145K denote toner cartridges that each contain the developer which includes at least the toner of a corresponding color and which is supplied to a corresponding one of the developing devices 14Y, 14M, 14C, and 14K.

Each first transfer device 15 is a contact transfer device including a first transfer roller that rotates while being in contact with the peripheral surface of the corresponding photoconductor drum 11 at a first transfer position T1 with the intermediate transfer belt 21 in between, and that receives a first transfer voltage. As the first transfer voltage, a direct-current voltage having a polarity that is opposite to a toner charging polarity is supplied from a power supply device (not shown).

Referring to FIG. 2, each drum cleaning device 16 includes, for example, a cleaning plate 161 and sending member 162, such as a screw auger. Each cleaning plate 161 is disposed at an inner portion of a body 160 having the form of a container, and removes and cleans off residual extraneous matter, such as residual toner. Each sending member 162 recovers the extraneous matter, such as the toner, removed by the cleaning plate 161 and sends the extraneous matter to a recovery system. As each cleaning plate 161, a plate member (such as a blade) formed of, for example, rubber is used.

As illustrated in FIG. 1, the intermediate transfer device 20 is disposed so as to exist at the upper side of each of the image producing devices 10Y, 10M, 10C, and 10K. The intermediate transfer device 20 principally includes an intermediate transfer belt 21, multiple belt supporting rollers 22 to 25, a second transfer device 30, and a belt cleaning device 26. The intermediate transfer belt 21 circulates in the direction of arrow B while passing each first transfer position T1 between the photoconductor drum 11 and the corresponding first transfer device 15 (the first transfer roller). The belt supporting rollers 22 to 25 hold the intermediate transfer belt 21 in a desired state from an inner periphery of the intermediate transfer belt 21, and support the intermediate transfer belt 21 so as to allow it to circulate freely. The second transfer device 30 is disposed at an outer peripheral surface (an image holding surface) of the intermediate transfer belt 21 that is supported by the belt supporting roller 23, and second-transfers toner images on the intermediate transfer belt 21 to recording paper 5. The belt cleaning device 26 removes and cleans off extraneous matter, such as toner or paper powder, remaining on the outer peripheral surface of the intermediate transfer belt 21 after passing the second transfer device 30.

As the intermediate transfer belt 21, an endless belt formed of a material in which, for example, a resistance adjustment agent, such as carbon black, is dispersed in synthetic resin, such as polyimide resin or polyamide resin, is used. The belt supporting roller 22 is formed as a driving roller. The belt supporting roller 25 is formed as a driven roller that maintains, for example, a movement position of the intermediate transfer belt 21. The belt supporting roller 24 is formed as a tension applying roller. The belt supporting roller 23 is formed as a second-transfer backup roller.

As illustrated in FIG. 1, the second transfer device 30 is formed as a second transfer roller that rotates at the second transfer position T2 at the intermediate transfer device 20 where the outer peripheral surface of the intermediate transfer belt 21 is supported by the belt supporting roller 23. As a second transfer voltage, a direct-current voltage having a polarity that is the same as or opposite to a toner charging polarity is supplied to the second transfer roller 30 or to the supporting roller 23 of the intermediate transfer device 20.

As illustrated in FIG. 1, the fixing device 40 includes, for example, a heating rotary member 41 and a pressure rotary member 42. The heating rotary member 41 is a roller or a belt that is heated by a heating unit (a heat source) such that its surface temperature is maintained at a predetermined temperature. The pressure rotary member 42 is a roller or a belt that rotates while contacting the heating rotary member 41 with a required pressure. In the fixing device 40, a contact portion where the heating rotary member 41 and the pressure rotary member 42 contact each other corresponds to a fixing portion where a required fixing operation (including heating and application of pressure) is carried out.

As illustrated in FIG. 1, the sheet feeding device 50 is disposed below the multiple image producing devices 10Y, 10M, 10C, and 10K. The sheet feeding device 50 principally includes one sheet container 51 (or multiple sheet containers 51) and a sending device 52. The sheet container 51 contains pieces of recording paper 5 of, for example, a desired size or type that are stacked upon each other. The sending device 52 sends the pieces of recording paper 5 one at a time from the sheet container 51. The sheet container 51 is mounted so as to be capable of being drawn out towards the front side of the body 1*a* of the image forming apparatus 1 (that is, the side that a user using the image forming apparatus 1 faces).

One pair of sheet transport rollers 53 (or multiple pairs of sheet transport rollers 53) and a sheet-feeding transport path 54 are provided between the sheet feeding device 50 and the second transfer device 30. The one pair of sheet transport rollers 53 transport the pieces of recording paper 5 that are sent from the sheet feeding device 50 to the second transfer position T2. The sheet-feeding transport path 54 includes transport guide members (not shown). The one pair of sheet transport rollers 53, which are disposed just in front of the second transfer position T2 at the sheet-feeding transport path 54, are formed as, for example, rollers that adjust the timing of transport of the pieces of recording paper 5 (that is, as register rollers).

A sheet discharge transport path 56 is provided downstream from (that is, above) the fixing device 40. The sheet discharge transport path 56 includes sheet discharge rollers 55 for discharging the recording paper 5 to which the toner images have been fixed by the fixing device 40 to a sheet discharge unit 57 disposed at a top portion of the body 1*a*.

Basic Operations of Image Forming Apparatus

The basic image forming operations that are performed by the image forming apparatus 1 are hereunder described.

Here, the image forming operations that are performed when the four image producing devices 10Y, 10M, 10C, and 10K are used to form a full-color image, which is a combination of toner images of four colors (Y, M, C, and K), are described.

When the image forming apparatus 1 receives information about an instruction that requests for image forming (printing) operations, for example, the four image producing devices 10Y, 10M, 10C, and 10K, the intermediate transfer device 20, the second transfer device 30, and the fixing device 40 start operating.

At the image producing devices 10Y, 10M, 10C, and 10K, first, the photoconductor drums 11 rotate in the direction of arrow A, and the charging devices 12 charge the surfaces of the respective photoconductor drums 11 to a required polarity (a negative polarity in the exemplary embodiment) and potential. Next, the exposure devices 13 irradiate the charged surfaces of the respective photoconductor drums 11 with lights that are emitted on the basis of image signals obtained by converting pieces of image information that are input to the image forming apparatus 1 into respective color components (Y, M, C, and K), to form on the surfaces of the photoconductor drums 11 electrostatic latent images for the respective color components of required potential differences.

Next, the developing devices 14Y, 14M, 14C, and 14K perform development in which toners of respective colors (Y, M, C, and K) charged to required polarities (negative polarities) are supplied to the electrostatic latent images for the respective color components formed on the photoconductor drums 11, so that the toners electrostatically adhere to the electrostatic latent images. By the development, the electrostatic latent images for the respective color components formed on the respective photoconductor drums 11 are rendered visible as toner images of the four respective colors (Y, M, C, and K) formed by the development using the toners of the respective colors.

Next, when the toner images of the respective colors formed on the photoconductor drums 11 of the respective image producing devices 10Y, 10M, 10C, and 10K are transported to the respective first transfer positions T1, the first transfer devices 15 first-transfer the toner images of the respective colors so as to successively superpose them upon each other on the intermediate transfer belt 21 of the intermediate transfer device 20 that rotates in the direction of arrow B.

In the image producing devices 10 where the first transfers have been completed, the drum cleaning devices 16 clean the surfaces of the respective photoconductor drums 11 by scraping off and removing extraneous matter from the surfaces of the respective photoconductor drums 11. This causes each of the image producing device 10 to be in a state allowing it to produce a next image.

Next, in the intermediate transfer device 20, the intermediate transfer belt 21 rotates to hold the toner images that have been first transferred, and transports the toner images to the second transfer position T2. The sheet feeding device 50 sends a required piece of recording paper 5 to the sheet-feeding transport path 54 in accordance with the image producing operations. In the sheet-feeding transport path 54, the pair of sheet transport rollers 53, which are register rollers, send and supply the recording paper 5 to the second transfer position T2 in accordance with the timing of transfer.

At the second transfer position T2, the second transfer roller 30 second-transfers the toner images on the intermediate transfer belt 21 to the recording paper 5 all at once. In the intermediate transfer device 20 after the second transfer has been completed, the belt cleaning device 26 removes and cleans off extraneous matter, such as toner, remaining on the surface of the intermediate transfer belt 21 after the second transfer.

Next, the recording paper 5 to which the toner images have been second-transferred is transported up to the fixing device 40 after the recording paper 5 has been separated from the intermediate transfer belt 21 and the second transfer roller 30. In the fixing device 40, the recording paper 5 after the second transfer is introduced into and caused to pass the contact portion where the rotating heating rotary member 41 and the pressure rotary member 42 contact each other, to fix the unfixed toner images to the recording paper 5. The recording paper 5 after the fixing has been completed is discharged to, for example, the sheet discharge unit 57, provided at the top portion of the image forming apparatus 1, by the sheet discharge rollers 55 via the sheet discharge path 56.

By the above-described operations, the recording paper 5 on which a full-color image, which is a combination of the toner images of the four colors, is formed is output.

Structure of Characteristic Portion of Image Forming Apparatus

Figure 6:
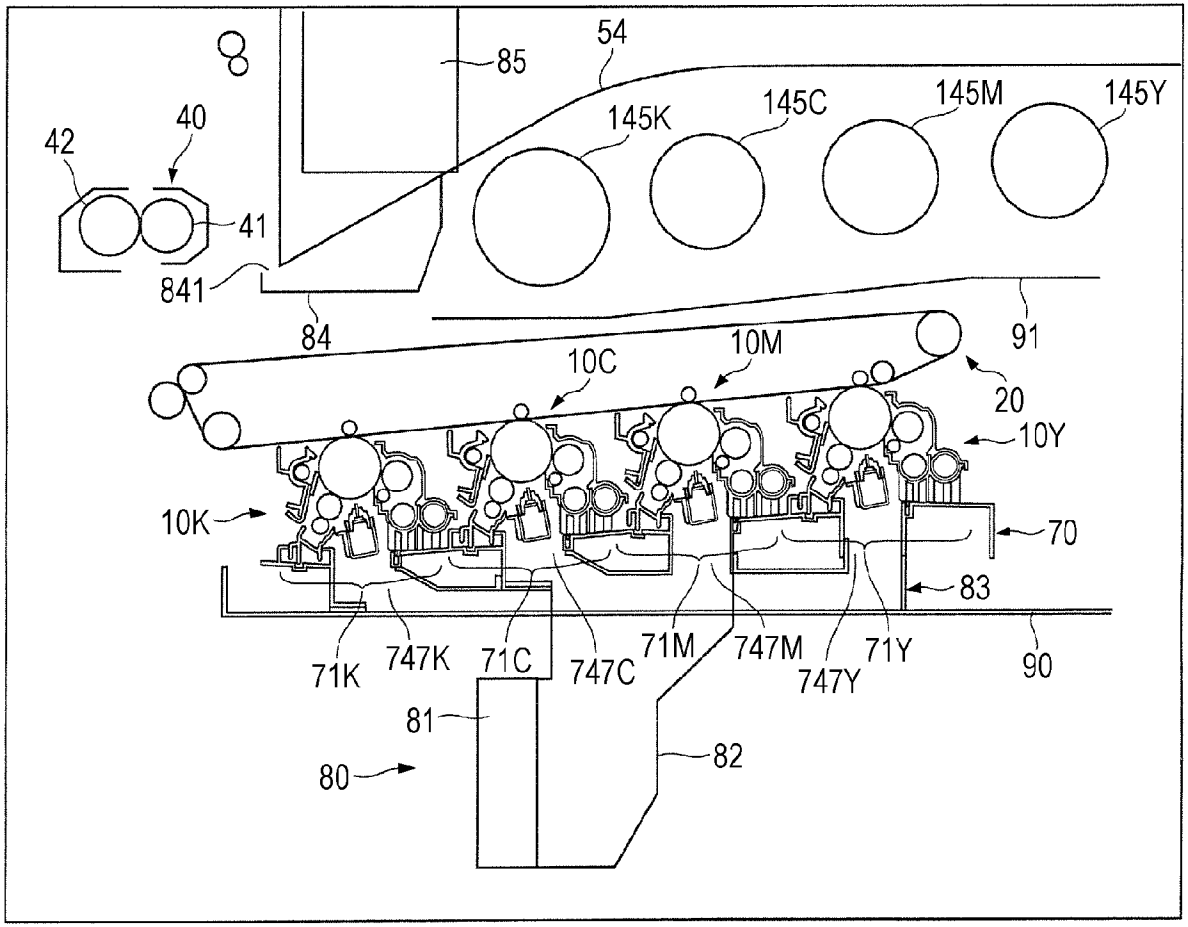
FIG. 6 illustrates the structure of the image forming apparatus.

FIGS. 2 and 6 illustrate the structure of the image forming apparatus according to the exemplary embodiment of the present invention. FIG. 6 illustrates the overall structure of the image forming apparatus along with the characteristic portion. FIG. 2 is an enlarged view of the principal portion of the image forming apparatus.

In the image forming apparatus 1 according to the exemplary embodiment, the image producing devices 10Y, 10M, 10C, and 10K of the four colors (yellow (Y), magenta (M), cyan (C), and black (K)) each include a photoconductor unit 61 (in which the corresponding photoconductor drum 11, the corresponding charging device 12, and the corresponding cleaning device 16 are integrated to each other), a developing unit 62 including the developing device 14, and an exposure unit 63 including the exposure device 13. The photoconductor units 61, the developing units 62, and the exposure units 63 are individually removable from the body 1*a* of the image forming apparatus 1. Although, in the exemplary embodiment, the case in which each exposure unit 63 includes a single exposure device 13 is described, the exposure device 13 may be integrally unitized with, for example, the photoconductor drum 11, the developing device 14, etc.

The image forming apparatus 1 includes a guide member 70 that is disposed below the image producing devices 10Y, 10M, 10C, and 10K (for yellow (Y), magenta (M), cyan (C), and black (K)) and that movably guides the photoconductor units 61, the developing units 62, and the exposure units 63 of the respective image producing devices 10Y, 10M, 10C, and 10K along the axial directions of the photoconductor drums 11. In the body 1*a* of the image forming apparatus 1, the guide member 70 is disposed above a partition plate 90 that divides a region between the sheet feeding device 50 and the image producing devices 10Y, 10M, 10C, and 10K for yellow (Y), magenta (M), cyan (C), and black (K). The guide member 70 includes guide portions 71Y, 71M, 71C, and 71K in correspondence with the image producing devices 10Y, 10M, 10C, and 10K for yellow (Y), magenta (M), cyan (C), and black (K). These guide portions 71Y, 71M, 71C, and 71K are disposed such that the guide portion 71Y for the image producing device 10Y for yellow (Y) is disposed at the highest position in a vertical direction and the guide portion 71K for the image producing device 10K for black (K) is disposed at the lowest position in the vertical direction.

The guide portions 71Y, 71M, 71C, and 71K have basically the same structure. Referring to FIG. 2, each of the guide portions 71Y, 71M, 71C, and 71K includes a photoconductor guide portion 72 that guides the photoconductor unit 61, a developing guide portion 73 that is disposed above the photoconductor guide portion 72 along a vertical direction and that guides the corresponding developing unit 62, and an exposure guide portion 74 that is disposed between the photoconductor guide portion 72 and the developing guide portion 73 and that guides the corresponding exposure unit 63.

Each photoconductor guide portion 72 includes a flat plate 721 that is disposed below the charging device 12 of the corresponding photoconductor unit 61, a recessed portion 722 that is provided at an intermediate portion of the flat plate 721, a left side wall 723 and a right side wall 724 that protrude upward from respective ends of the flat plate 721, and a left protrusion 725 and a right protrusion 726 that are provided on upper ends of the respective side walls 723 and 724 in such a manner as to extend inwardly and oppose each other.

Each photoconductor unit 61 includes multiple supporting legs 611, 612, and 613 (three supporting legs in the illustrated example) that are provided at lower ends of a housing 122 of the corresponding charging device 12 so as to extend downward. Of the supporting legs 611, 612, and 613, the outer supporting legs 611 and 613 are such that lower end portions thereof are supported by the flat plate 721 and the respective left and right protrusions 725 and 726 of the photoconductor guide portion 72, and the intermediate supporting leg 612 is disposed so as to be guided along the axial direction of the corresponding photoconductor drum 11 by the recessed portion 722 of the corresponding photoconductor guide portion 72.

Each developing guide portion 73 includes a flat plate 731 that is disposed below the developing device 14 of the corresponding developing unit 62 and a recessed portion 732 that is provided at one end (left end in the illustrated example) of the flat plate 731. Each developing unit 62 includes multiple downwardly extending supporting legs 621 to 628 (eight supporting legs in the illustrated example) that are provided at a lower end surface of the housing 140 of the corresponding developing device 14, and a protruding portion 629 that is provided so as to protrude downwardly of the supporting legs 621 to 628. Each of the supporting legs 621 to 628 is such that a lower end portion thereof is supported by the flat plate 731 of the corresponding developing guide portion 73, and the protruding portion 629 is guided while being inserted in the recessed portion 732 of the corresponding developing guide portion 73.

Figure 7:
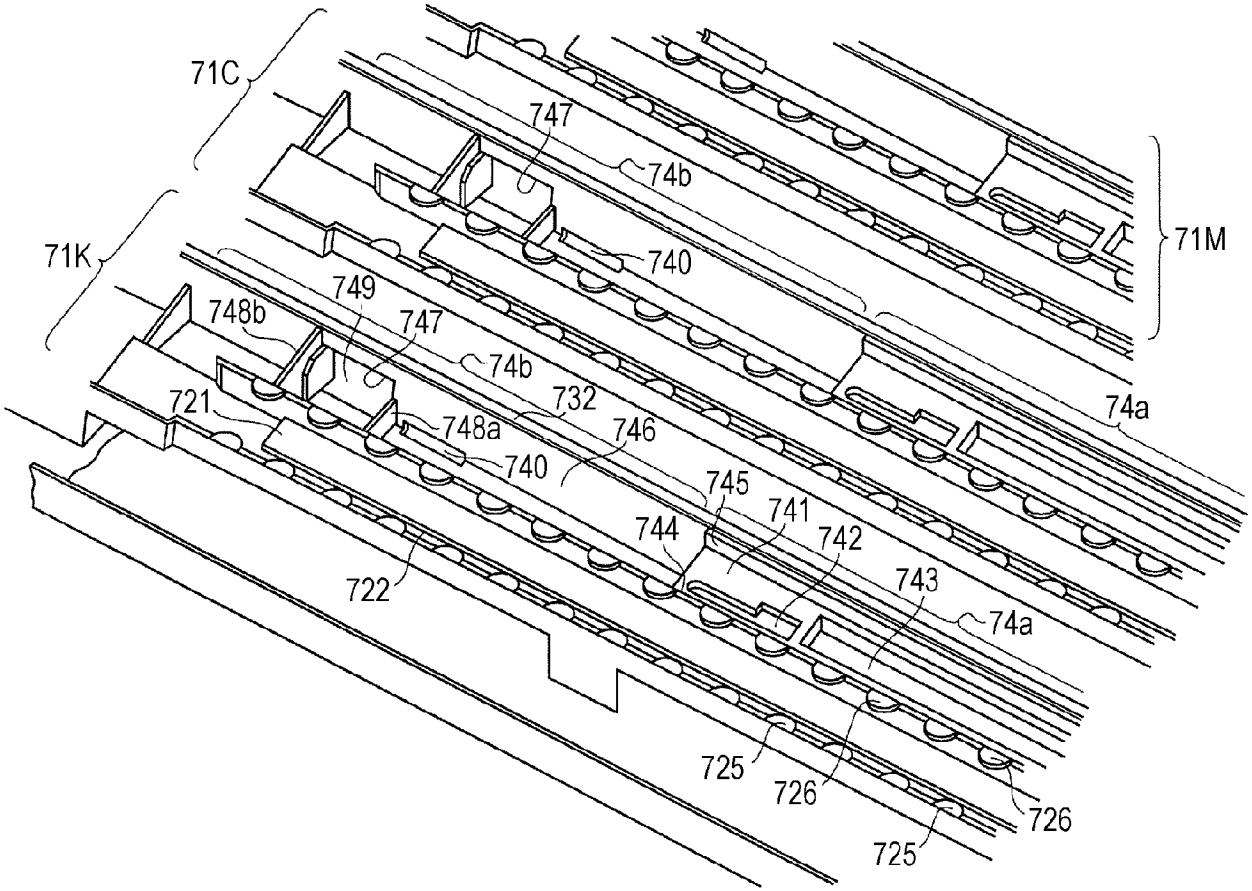
FIG. 7 is a perspective view of a structure of a guide member.

Referring to FIG. 2, each exposure guide portion 74 has the form of a recess in cross section in which a top end that is positioned adjacent to the corresponding photoconductor drum 11 is open. As illustrated in FIG. 7, each exposure guide portion 74 includes a first guide portion 74*a* and a second guide portion 74*b*. Each first guide portion 74*a* is provided up to an intermediate portion from an end portion at a front side (the side that a user using the image forming apparatus 1 faces) of the body 1*a* of the image forming apparatus 1 along the axial direction of the corresponding photoconductor drum 11. Each second guide portion 74*b* is provided up to a back side (the side opposite to the side that a user using the image forming apparatus 1 faces) from the intermediate portion of the body 1*a* of the image forming apparatus 1. Each first guide portion 74*a* is provided for movably guiding the corresponding exposure unit 63 along the axial direction of the corresponding photoconductor drum 11, and for positioning and securing the corresponding exposure unit 63 at a desired position. Each second guide portion 74*b* is provided for accommodating the wire harness 139 at the corresponding exposure device 13 and for forming an air blow opening 747 for sending a flow of air into a closed space surrounded by the charging device 12 and the developing device 14 and the exposure device 13.

Each bottom wall 741, which is positioned at an end portion of the back surface of the corresponding first guide portion 74*a*, has an insertion hole 742 for inserting therein the corresponding positioning member 134*f* (see FIG. 5), which is provided at the lower end surface of the housing 134 of the corresponding exposure device 13. Each recess 743, which is provided along the axial direction of the corresponding photoconductor drum 11 at a position that is closer to the front side than the corresponding insertion hole 742, is formed in the corresponding bottom wall 741, which is positioned at the end portion of the back surface of the corresponding first guide portion 74*a*. Each recess 743 is provided for inserting therein the corresponding guide pin 134*e* (see FIG. 5), which is provided at the lower end surface of the housing 134 of the corresponding exposure device 13. Referring to FIG. 2, side walls 744 and 745, which function as guide portions that contact and guide the respective side walls 134*a* and 134*b* of the housing 134 of the corresponding exposure device 13, are provided at the first guide portion 74*a* of the corresponding exposure guide portion 74.

Figure 8:
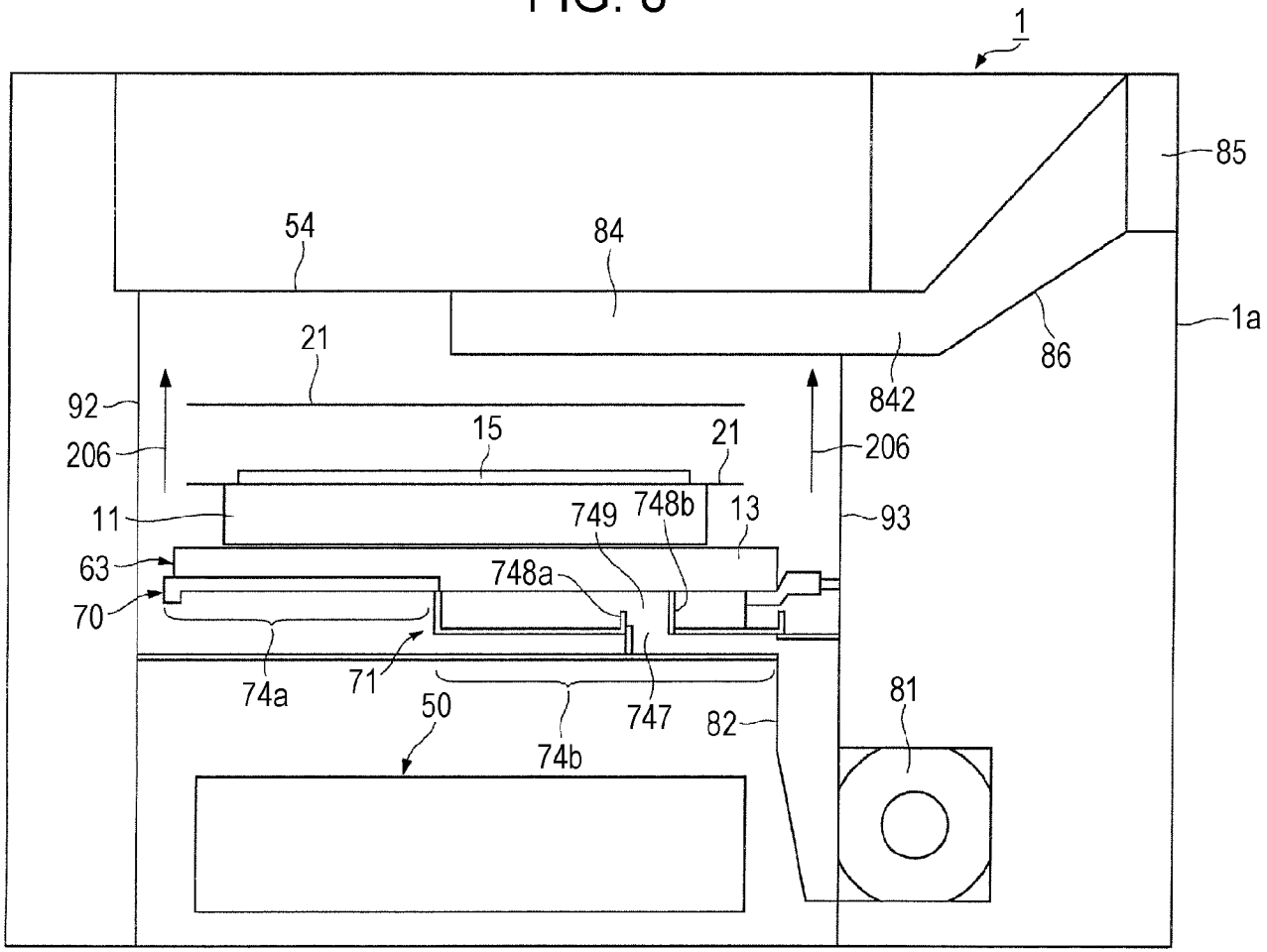
FIG. 8 is a schematic view of the structure of the image forming apparatus.

As illustrated in FIG. 7, each accommodating chamber 746, which accommodates the wire harness 139 of the corresponding exposure device 13 at the front side of the corresponding second guide portion 74*b*, is formed at the second guide portion 74*b* of the corresponding exposure guide portion 74 so as to be relatively deeper than the corresponding first guide portion 74*a*. As illustrated in FIGS. 7 and 8, each air blow opening 747 is formed at the back side of the second guide portion 74*b* of the corresponding exposure guide portion 74, and each air blow passage 749, which is partitioned by a corresponding partition wall 748*a* and a corresponding partition wall 748*b*, is formed in the second guide portion 74*b* of the corresponding exposure guide portion 74. Among the partition walls 748*a* and 748*b*, the back partition walls 748*b* have heights that are larger than the heights of the front partition walls 748*a* so as to reach upper end portions of the corresponding second guide portions 74*b*, and are such that a flow of air that is blown from the corresponding air blow openings 747 is more effectively introduced by the inlets 134*d* of the corresponding exposure devices 13.

As illustrated in FIG. 6, in the exposure guide portion 74 for yellow and the exposure guide portion 74 for magenta, the air blow openings 747, which are provided at the second guide portions 74*b* of the corresponding exposure guide portions 74, open at bottom walls of the corresponding second guide portions 74*b*; whereas, in the exposure guide portion 74 for cyan and the exposure guide portion 74 for black, the air blow openings 747, which are provided at the second guide portions 74*b* of the corresponding exposure guide portions 74, open over the back walls and the side walls of the corresponding second guide portions 74*b*.

The image forming apparatus 1 includes an air blowing device 80, which is an exemplary air flow producing unit, that produces air flow that is introduced into each exposure device 13 from the corresponding air blow opening 747, which is provided at a position corresponding to the position of the inlet 134*d* of the corresponding exposure device 13, when the corresponding exposure device 13 is mounted on the body 1*a* of the image forming apparatus 1.

As illustrated in FIG. 6, the air blowing device 80 generally includes an air intake fan 81 (which is an exemplary air intake unit), a deflecting duct 82, a branching duct 83 (which is an exemplary branching member), an exhaust duct 84, and an exhaust fan 85 (which is an exemplary exhaust unit). The deflecting duct 82 changes the direction of the flow of air that is sent from the air intake fan 81 (hereunder referred to as "air flow") to guide the air flow to portions below the respective image producing devices 10Y, 10M, 10C, and 10K. The branching duct 83 causes the air flow that has been guided to the portions below the image producing devices 10Y, 10M, 10C, and 10K by the deflecting duct 82 to be branched at each of the image producing device 10Y for yellow (Y), the image producing device 10M for magenta (M), the image producing device 10C for cyan (C), and the image producing device 10K for black (K). The exhaust duct 84 is provided for sucking the air in the body 1*a* of the image forming apparatus 1 from the position that corresponds to the position above the image producing device 10K (for black) and for discharging the sucked air to the outside. The exhaust fan 85 is provided for exhausting the air flow sucked from the exhaust duct 84 to the outside of the image forming apparatus 1.

In FIG. 6, reference numeral 91 denotes a partition plate that is provided between the intermediate transfer device 20 and the toner cartridges 145Y, 145M, 145C, and 145K.

As illustrated in FIGS. 6 and 8, the air intake fan 81 is disposed at the back side of the body 1*a* of the image forming apparatus 1. When described further, the air intake fan 81 is disposed at a position that corresponds to a position below the image producing device 10C for cyan at the back side of the sheet feeding device 50 so as to blow air towards the image producing device 10M for magenta from the image producing device 10K for black. The deflecting duct 82 is provided at an outlet of the air intake fan 81. The deflecting duct 82 changes the direction of the air flow that is produced by the air intake fan 81 from the back side to the front side of the body 1*a* of the image forming apparatus 1 and from a horizontal direction to an upward direction along a vertical direction. An exhaust opening of the deflecting duct 82 opens at an upper side of the partition plate 90 so as to allow air to be blown towards the front side from the back side of the image forming apparatus 1 along the surface of the partition plate 90.

The branching duct 83 is provided on the top surface of the partition plate 90. The branching duct 83 branches the air flow whose direction has been changed to the upward direction along the vertical direction by the deflecting duct 82 at the image producing device 10Y for yellow, the image producing device 10M for magenta, the image producing device 10C for cyan, and the image producing device 10K for black along the surface of the partition plate 90, and sends the branched air flow. The branching duct 83 is disposed between the partition plate 90 and the guide member 70.

Figure 9:
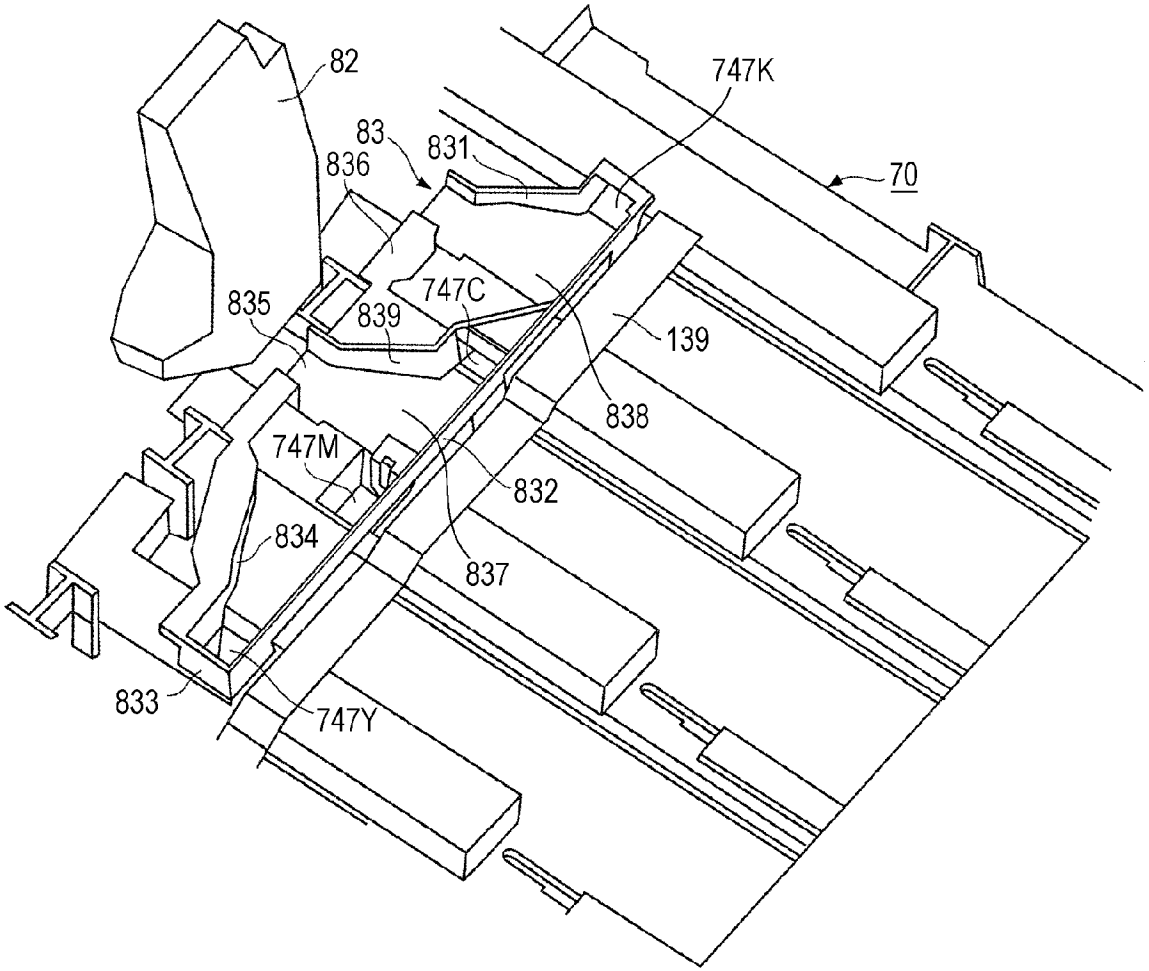
FIG. 9 is a perspective view of a structure of a branching duct.

FIG. 9 is a perspective view of the guide member 70 and the branching duct 83 as seen from obliquely below the guide member 70 and the branching duct 83 with the partition plate removed from the body 1*a* of the image forming apparatus 1.

As illustrated in FIG. 9, the branching duct 83 is disposed with its bottom surface being in contact with the top surface of the partition plate 90, and includes outer peripheral walls 831 to 834 having a flat trapezoidal shape. The branching duct 83 has openings 835 and 836 at an end portion thereof adjacent to the deflecting duct 82. The openings 835 and 836 are provided for introducing air flow. The inside of the branching duct 83 is divided into a flow path 837 for colors and a flow path 838 for black by a branching wall 839. The flow path 837 for colors is used for guiding an air intake flow to the image producing devices for colors, that is, the image producing device for yellow, the image producing device for magenta, and the image producing device for cyan. The flow path 838 for black is used for guiding air intake flow to the image producing device 10K for black. The branching duct 83 is connected to the air blow openings 747Y and 747M, which are provided at bottom walls of the respective guide portion 71Y for yellow and guide portion 71M for magenta. The branching duct 83 is also connected to the air blow openings 747C and 747K, which are provided along the side walls and bottom walls of the respective guide portions 71C and 71K for cyan and black.

In FIG. 8, reference numeral 139 denotes a wire cable that is connected to each of the exposure devices 13.

In the body 1*a* of the image forming apparatus 1, as illustrated in FIG. 6, the exhaust duct 84 for exhausting air flow that has been blown to each of the image producing devices 10Y, 10M, 10C, and 10K to the outside of the body 1*a* of the image forming apparatus 1 is disposed above the image producing device 10K for black so as to be positioned at the back side of the sheet discharge unit 57. As illustrated in FIG. 8, the exhaust duct 84 is provided from an intermediate portion to an end portion at the back side along the axial direction of the photoconductor drums 11. The exhaust duct 84 is disposed in correspondence with and above the position of the black image producing device 10K such that an opening 841 faces the fixing device 40. The exhaust duct 84 is formed such that its opening width (opening area) gradually increases towards the intermediate portion from an end portion at the front side along the axial direction of the photoconductor drums 11.

As illustrated in FIG. 8, a base end portion 842 of the exhaust duct 84 (the end portion at the back side) is connected to the exhaust fan 85 (disposed at an upper portion at the back side of the image forming apparatus 1) via the duct 86. If necessary, the exhaust fan 85 is equipped with a filter that removes, for example, toner, ozone, or nitrogen oxides.

In FIG. 8, reference numerals 92 and 93 denote a front frame and a back frame, respectively, with the front frame being disposed at the front side and the back frame being disposed at the back side of the image forming apparatus 1 in the image forming apparatus 1.

Operation of Characteristic Portion of Image Forming Apparatus

In the image forming apparatus 1 according to the exemplary embodiment, air is blown to, for example, the exposure devices 13 of the image forming apparatus 1 as follows.

Figure 10:
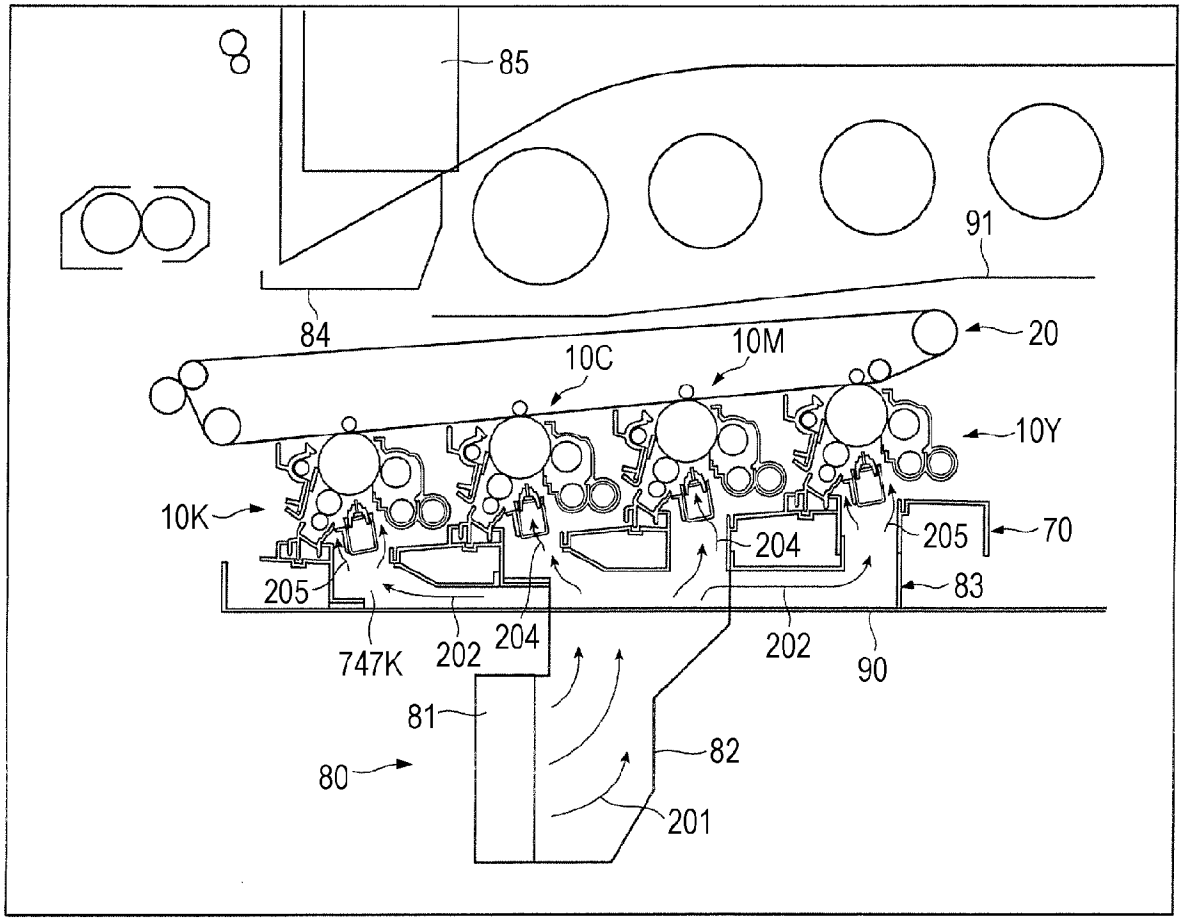
FIG. 10 is a structural view illustrating air flow in the image forming apparatus.

When the image forming apparatus 1 receives information about an instruction that requests for image forming (printing) operations, as shown in FIG. 10, the air intake fan 81 and the exhaust fan 85 are driven. Here, in the image forming apparatus 1, a temperature sensor (not shown) detects the temperature of the inside of the body 1*a* of the image forming apparatus 1.

In the image forming apparatus 1, as illustrated in FIG. 10, when the air intake fan 81 is driven, the body 1*a* of the image forming apparatus 1 takes in outside air. Air flow 201 that is taken in by the body 1*a* of the image forming apparatus 1 by using the air intake fan 81 is guided to portions below the respective image producing devices 10Y, 10M, 10C, and 10K via the deflecting duct 82. Air flow 202 that has been guided to the portions below the respective image producing devices 10Y, 10M, 10C, and 10K is branched at the image producing devices 10Y, 10M, 10C, and 10K by the branching duct 83, and the branched portions of the air flow 202 are sent to the respective guide portions 71Y, 71M, 71C, and 71K of the guide member 70 for the exposure devices 13 of the respective image producing devices 10Y, 10M, 10C, and 10K.

Figure 11:
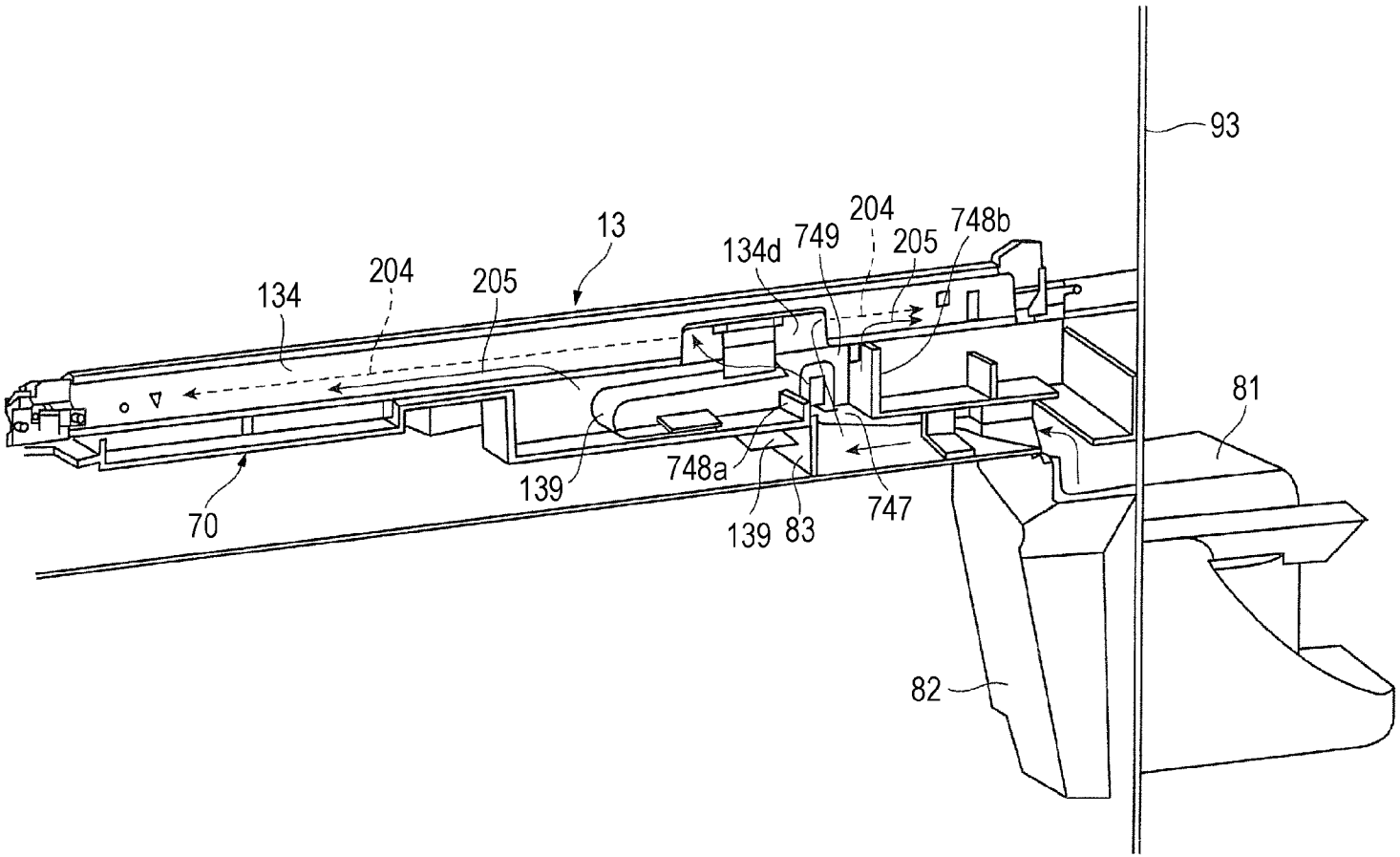
FIG. 11 is a structural perspective view illustrating air flow in the image forming apparatus.

As illustrated in FIG. 8, the air blow openings 747Y, 747M, 747C, and 747K are provided at the respective guide portions 71Y, 71M, 71C, and 71K of the guide member 70 so as to be positioned in correspondence with the inlets 134*d* of the housings 134 of the exposure devices 13 of the respective image producing devices 10Y, 10M, 10C, and 10K. Therefore, as illustrated in FIG. 8, part of air flow 203 that has been sent to the guide portions 71Y, 71M, 71C, and 71K of the respective image producing devices 10Y, 10M, 10C, and 10K is guided to the insides of the housings 134 of the respective exposure devices 13 from the respective air blow openings 747Y, 747M, 747C, and 747K via the respective inlets 134*d*. As illustrated in FIG. 11, air flow 204 that has been introduced into the housings 134 of the respective exposure devices 13 cools the LED circuit substrates 131 of the respective exposure devices 13 while the air flow 204 flows from the front side and the back side of the image forming apparatus 1 along the longitudinal direction of the housings 134. Air flow 205 that has been introduced into a location between each of the guide portions 71Y, 71M, 71C, and 71K and the housing 134 of the corresponding exposure device 13 is, as illustrated in FIG. 10, sent to an upstream side and a downstream side of the corresponding photoconductor drum 11 along a direction of rotation of the corresponding photoconductor drum 11, and flows towards the back side and the front side of the closed space (surrounded by the corresponding charging device 12 and the corresponding developing device 14) along the axial direction of the corresponding photoconductor drum 11.

Figure 12:
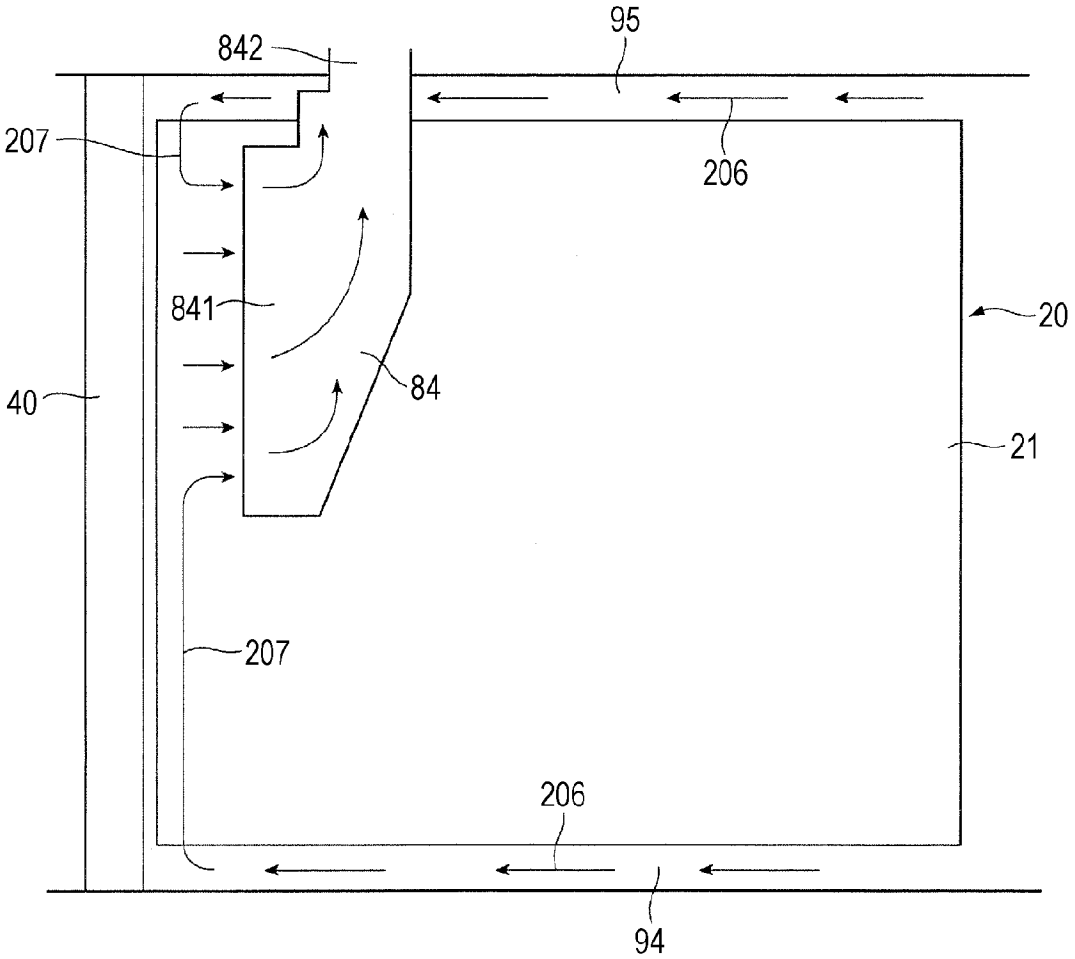
FIG. 12 is a structural view illustrating air flow in the image forming apparatus.

Thereafter, as shown in FIGS. 10 and 12, air flow 206 that has flown to the insides and outer peripheral portions of the exposure devices 13 and to the front side and the back side of the closed spaces surrounded by the charging devices 12 and the respective developing devices 14 along the axial direction of the photoconductor drums 11 flows upward via gaps 94 and 95 formed between the frame 92 and the frame 93 at the front and back sides and the intermediate transfer device 20 and each of the image producing devices 10Y, 10M, 10C, and 10K.

Air flow 207 that has flown upward is sucked from the air take-in opening 841 of the exhaust duct 84 (disposed above the image producing device 10K for black), and, as illustrated in FIG. 8, is exhausted to the outside of the body 1*a* of the image forming apparatus 1 via the duct 86 and the exhaust fan 85.

Accordingly, in the above-described exemplary embodiment, as illustrated in FIGS. 10 and 11, each exposure device 13 (which is disposed in the closed space surrounded by the corresponding charging device 12 and the corresponding developing device 14 and which includes the LED circuit board 131 in the corresponding housing 134) is capable of being directly cooled by the air flow that is sent into the exposure device from the corresponding air blow opening 747 (which opens at the position corresponding to the position of the corresponding inlet 134*d*) via the corresponding inlet 134*d* (which is formed to the bottom side from a side of the housing 134 of the corresponding exposure device 13). Therefore, it is possible to efficiently cool each exposure device 13.

Since the air flow that has been sent from each air flow opening 747 flows along the front side and the back side of the body 1*a* of the image forming apparatus 1 in such a manner as to flow along the guide portions 71Y, 71M, 71C, and 71K of the guide members 70, it is possible to cool each closed space formed between the corresponding developing device 14 and the corresponding charging device 12 adjacent to the corresponding exposure device 13. Therefore, it is possible to prevent or reduce the occurrence of improper charging of each photoconductor drum 11 caused by, for example, variations in the outer diameter of each charging roller 12 when the temperature of the charging roller of each charging device adjacent to the corresponding exposure device 13 rises. In addition, it is possible to prevent or reduce the occurrence of, for example, the blocking of toner in each developing device 14 when the temperature near the layer thickness restricting member 144 of the corresponding developing device 14 adjacent to the exposure device 13 rises.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an exposure unit comprising a plurality of light emitting elements provided on a substrate, the substrate provided inside a housing of the exposure unit, the exposure unit configured to form a latent image by irradiating a photoconductor body with light by using the plurality of light emitting elements that are arranged along an axial direction of the photoconductor body, the housing having an inlet through which air flow is introduced inside the housing to cool the substrate; and an air blowing unit configured to produce the air flow that is introduced to the exposure unit from an air blow opening that is provided at a position that is in correspondence with a position of the inlet of the exposure unit.

2. The image forming apparatus according to claim 1, wherein the inlet is provided in an intermediate portion excluding opposite end portions along a longitudinal direction of the housing of the exposure unit, the longitudinal direction being substantially parallel to the axial direction of the photoconductor body.

3. The image forming apparatus according to claim 2, wherein a portion of the air flow that is sent to the exposure unit from the air blow opening of the air blowing unit is guided towards an upstream side and a downstream side along a direction of rotation of the photoconductor body of the exposure unit.

4. The image forming apparatus according to claim 1, wherein a portion of the air flow that is sent to the exposure unit from the air blow opening of the air blowing unit is guided towards an upstream side and a downstream side along a direction of rotation of the photoconductor body of the exposure unit.

5. The image forming apparatus according to claim 1, wherein the plurality of light emitting elements are provided on a first surface of the substrate, and wherein the air flow cools a second surface opposite to the first surface of the substrate.

6. An image forming apparatus comprising:

an exposure unit comprising light emitting element array provided on a substrate, the substrate provided inside a housing of the exposure unit and removably provided at a body of the image forming apparatus, the exposure unit configured to form a latent image by irradiating a photoconductor body with light by using the plurality of light emitting elements of the light emitting element array that are arranged along an axial direction of the photoconductor body, the housing having an inlet through which air flow is introduced inside the housing to cool the substrate; and an air blowing unit, when the exposure unit is mounted on the body of the image forming apparatus, configured to produce the air flow that is introduced to the exposure unit from an air blow opening that is provided at a position that is in correspondence with a position of the inlet of the exposure unit.

7. The image forming apparatus according to claim 6, wherein the inlet is provided in an intermediate portion excluding opposite end portions along a longitudinal direction of the housing of the exposure unit, the longitudinal direction being substantially parallel to the axial direction of the photoconductor body.

8. The image forming apparatus according to claim 7, wherein a portion of the air flow that is sent to the exposure unit from the air blow opening of the air blowing unit is guided towards an upstream side and a downstream side along a direction of rotation of the photoconductor body of the exposure unit.

9. The image forming apparatus according to claim 6, wherein a portion of the air flow that is sent to the exposure unit from the air blow opening of the air blowing unit is guided towards an upstream side and a downstream side along a direction of rotation of the photoconductor body of the exposure unit.

10. The image forming apparatus according to claim 6, wherein the plurality of light emitting elements are provided on a first surface of the substrate, and wherein the air flow cools a second surface opposite to the first surface of the substrate.

11. An image forming apparatus comprising:

an exposure unit that is removably provided at a body of the image forming apparatus, the exposure unit configured to form a latent image by irradiating a photoconductor body with light by using a plurality of light emitting elements that are arranged along an axial direction of the photoconductor body, the exposure unit having an inlet to which air flow is introduced; and an air blowing unit that, when the exposure unit is mounted on the body of the image forming apparatus, configured to produce the air flow that is introduced to the exposure unit from an air blow opening that is provided at a position that is in correspondence with a position of the inlet of the exposure unit, wherein the exposure unit is removably provided at the body of the image forming apparatus by moving along a guide portion that is provided at the body of the image forming apparatus, the exposure unit including a housing that is guided by the guide portion, wherein the inlet is provided in the housing of the exposure unit, and wherein the air blow opening is provided in the guide portion at the body of the image forming apparatus in correspondence with the inlet that is provided in the housing of the exposure unit.

12. The image forming apparatus according to claim 11, wherein the inlet is provided in an intermediate portion excluding opposite end portions along a longitudinal direction of the housing of the exposure unit, the longitudinal direction being substantially parallel to the axial direction of the photoconductor body.

13. The image forming apparatus according to claim 12, wherein a portion of the air flow that is sent to the exposure unit from the air blow opening of the air blowing unit is guided towards an upstream side and a downstream side along a direction of rotation of the photoconductor body of the exposure unit.

14. The image forming apparatus according to claim 11, wherein a portion of the air flow that is sent to the exposure unit from the air blow opening of the air blowing unit is guided towards an upstream side and a downstream side along a direction of rotation of the photoconductor body of the exposure unit.

* * * * *